US005208402A

United States Patent [19]

Wilson

[11] Patent Number: 5,208,402

[45] Date of Patent: * May 4, 1993

[54] LIQUID FUELS FOR INTERNAL COMBUSTION ENGINES AND PROCESS AND APPARATUS FOR MAKING SAME

[75] Inventor: Ewert J. A. Wilson, Albany, Ky.

[73] Assignee: Interstate Chemical, Inc., White Pine, Tenn.

[ * ] Notice: The portion of the term of this patent subsequent to Apr. 2, 2008 has been disclaimed.

[21] Appl. No.: 756,216

[22] Filed: Sep. 5, 1991

Related U.S. Application Data

[63] Continuation-in-part of Ser. No. 678,790, Apr. 1, 1991, abandoned, which is a continuation-in-part of Ser. No. 529,878, May 25, 1990, Pat. No. 5,093,533, and a continuation-in-part of Ser. No. 447,543, Dec. 8, 1989, Pat. No. 5,004,850.

[51] Int. Cl.[5] ..... C07C 7/20; C10L 1/16

[52] U.S. Cl. ..... 585/1; 585/7; 585/13; 585/14; 208/16; 208/17

[58] Field of Search ..... 585/14, 1, 7, 13

[56] References Cited

U.S. PATENT DOCUMENTS

| | | |
|---|---|---|
| Re. 22,786 | 9/1946 | Goldsby . |
| 1,013,881 | 1/1912 | Kohn . |
| 1,014,943 | 1/1912 | Bray . |
| 1,135,506 | 4/1915 | Dubbs . |
| 1,179,001 | 4/1916 | Gay . |
| 1,429,175 | 9/1922 | Thompson . |
| 1,510,434 | 9/1924 | Hosmer . |
| 1,516,757 | 11/1924 | Weber . |
| 1,567,457 | 12/1925 | Newton . |
| 1,683,826 | 9/1928 | Huff . |
| 1,690,988 | 11/1928 | Marley et al. . |
| 1,758,590 | 5/1930 | Wilson . |
| 1,784,561 | 12/1930 | Watts et al. . |
| 1,924,196 | 8/1933 | Miller . |
| 1,954,939 | 4/1934 | Magness . |
| 2,018,778 | 10/1935 | Ebner . |
| 2,032,330 | 3/1936 | Roberts et al. . |
| 2,032,666 | 3/1936 | Roberts . |
| 2,108,659 | 2/1938 | Dunham . |
| 2,109,201 | 2/1938 | Ragatz . |
| 2,113,588 | 4/1938 | Greenewalt . |
| 2,125,325 | 8/1938 | Youker . |
| 2,184,596 | 12/1939 | Hutchinson . |
| 2,190,480 | 2/1940 | Nichols, Jr. et al. . |
| 2,303,609 | 12/1942 | Carney . |
| 2,340,778 | 2/1944 | Steward et al. . |
| 2,361,054 | 10/1944 | Pevere . |
| 2,388,732 | 11/1945 | Finsterbusch . |
| 2,560,645 | 7/1951 | Hays . |
| 3,009,787 | 11/1961 | Ruble . |
| 3,009,789 | 11/1961 | Jordan et al. . |
| 3,034,878 | 5/1962 | McCall . |
| 3,371,032 | 2/1968 | Witt et al. . |
| 3,385,680 | 5/1968 | Feld et al. . |
| 4,770,747 | 9/1988 | Muller . |
| 4,773,916 | 9/1988 | Croudace et al. . |
| 4,812,146 | 3/1989 | Jessup . |
| 5,004,850 | 4/1991 | Wilson ..... 585/1 |
| 5,093,533 | 3/1992 | Wilson ..... 585/1 |

FOREIGN PATENT DOCUMENTS

| | | |
|---|---|---|
| 0078292 | 5/1984 | Japan . |

*Primary Examiner*—Asok Pal
*Attorney, Agent, or Firm*—Quarles & Brady

[57] ABSTRACT

Internal combustion engine liquid fuels are produced by the mixing of a natural gasoline component and at least one octane-enhancing component. The mix is weathered during the blending operation to remove light-weight hydrocarbons comprising one- to four-carbon components. The light-weight hydrocarbons, which preferably constitute less than 3 percent of the blended fuel, can be recovered to generate power to run the process. The liquid fuel mixture is formulated to produce a desired octane rating, an environmentally acceptable vapor pressure, and a mix which, when burned in an internal combustion engine, produces a minimum amount of pollutants.

13 Claims, 1 Drawing Sheet

LIQUID FUELS FOR INTERNAL COMBUSTION ENGINES AND PROCESS AND APPARATUS FOR MAKING SAME

CROSS-REFERENCE TO RELATED APPLICATIONS

This application is a continuation-in-part application of Applicant's co-pending application Ser. No. 678,790, filed Apr. 1, 1991, now abandoned, which is a continuation-in-part application of Applicant's co-pending applications Ser. No. 529,878, filed May 25, 1990 now U.S. Pat. No. 5,093,533, and Ser. No. 447,543, filed Dec. 8, 1989, now U.S. Pat. No. 5,004,850.

FIELD OF THE INVENTION

The present invention relates to liquid fuels, and more particularly to liquid fuels for internal combustion engines and processes and apparatus for making these fuels.

BACKGROUND OF THE INVENTION

Petroleum reserves are decreasing, and the cost of locating and recovering new liquid gasoline reserves is increasing. Large amounts of low-weight hydrocarbon components and natural gasoline are available, but have not been extensively utilized as fuels for motor vehicles and other internal combustion engines. This is despite the relatively low cost of these fuels. These fuels have a high vapor pressure at standard temperatures and pressures, and accordingly, vapor losses to the atmosphere by open-container storage are environmentally unacceptable. These fuels are more difficult to store and to dispense than currently available gasolines, and would require modification of standard liquid gasoline burning vehicles. Also, natural gasoline has a lower octane than is acceptable for present day automotive engines.

SUMMARY OF THE INVENTION

It is an object of the invention to provide a liquid fuel for internal combustion engines.

It is another object of the invention to provide a liquid fuel for internal combustion engines which utilizes natural gasoline resources.

It is still another object of the invention to provide a liquid fuel for internal combustion engines with an environmentally acceptable vapor pressure.

It is another object of the invention to provide a liquid fuel for internal combustion engines with an acceptable octane rating.

It is yet another object of the invention to provide a fuel for internal combustion engines which can be produced at relatively low cost.

These and other objects are accomplished by blending at least one natural gasoline component and at least one octane-enhancing component. The natural gasoline component preferably contains hydrocarbons having from about 4 to about 12 carbons. Most preferably, the natural gasoline component contains at least 60 volume percent of 5 and 6 carbon hydrocarbons and at least 20 volume percent of hydrocarbons having 7 or more carbons.

The octane-enhancing component can be selected from several suitable compounds, and can also include mixtures of compounds. The octane-enhancing components will preferably have a high octane rating with an $(R+M)/2$ octane of greater than about 85. The octane-enhancing components should preferably also have a low vapor pressure, with a Reid vapor pressure of less than about 8 psia, and most preferably of about 1 psia or less.

Toluene, alone or in combination with other octane-enhancing components, is a presently preferred octane-enhancing component. The toluene component should be relatively pure, although up to about 10 volume percent of the toluene component can be other hydrocarbons. Other suitable octane-enhancing components include methyl tertiary butyl ether (MTBE); tertiary anyl methyl ether (TAME); ethyl tertiary butyl ether (ETBE); ethylbenzene; m-xylene; p-xylene; o-xylene; eight carbon aromatic mixtures; nine carbon aromatic mixtures; cumene (isopropylbenzene); n-propylbenzene; and alkylates (isoparaffins). Catalytic cracked naphtha, catalytic reformate, and pyrolysis gasoline can also be used, but will likely result in increased emissions.

The octane-enhancing components are added and mixed with the natural gasoline component. A vapor stream of light-weight hydrocarbons is released from the natural gasoline, before, during and/or after blending with the octane-enhancing component. The natural gasoline mixture is agitated or otherwise caused to form particles or droplets to increase the surface area of the liquid and to facilitate the release of light-weight hydrocarbons from the liquid. The light-weight hydrocarbons which are released from the liquid blend can be burned to generate heat energy to power the pumps and to provide for the other energy requirements of the process. Alternatively, these light-weight hydrocarbons can be stored for later use. The weathering process preferably continues until a substantially homogeneous mixture is obtained with the desired Reid vapor pressure, which is specified by government regulations that are based upon seasonal and other considerations.

The resulting product normally will be a liquid fuel with about 30–80 volume percent natural gasoline, about 20–50 volume percent octane-enhancing components, and may also contain about 0–35 volume percent low-weight hydrocarbons. The proportions of the components can be adjusted to vary the octane rating and vapor pressure of the product fuel.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figures 1, 2:
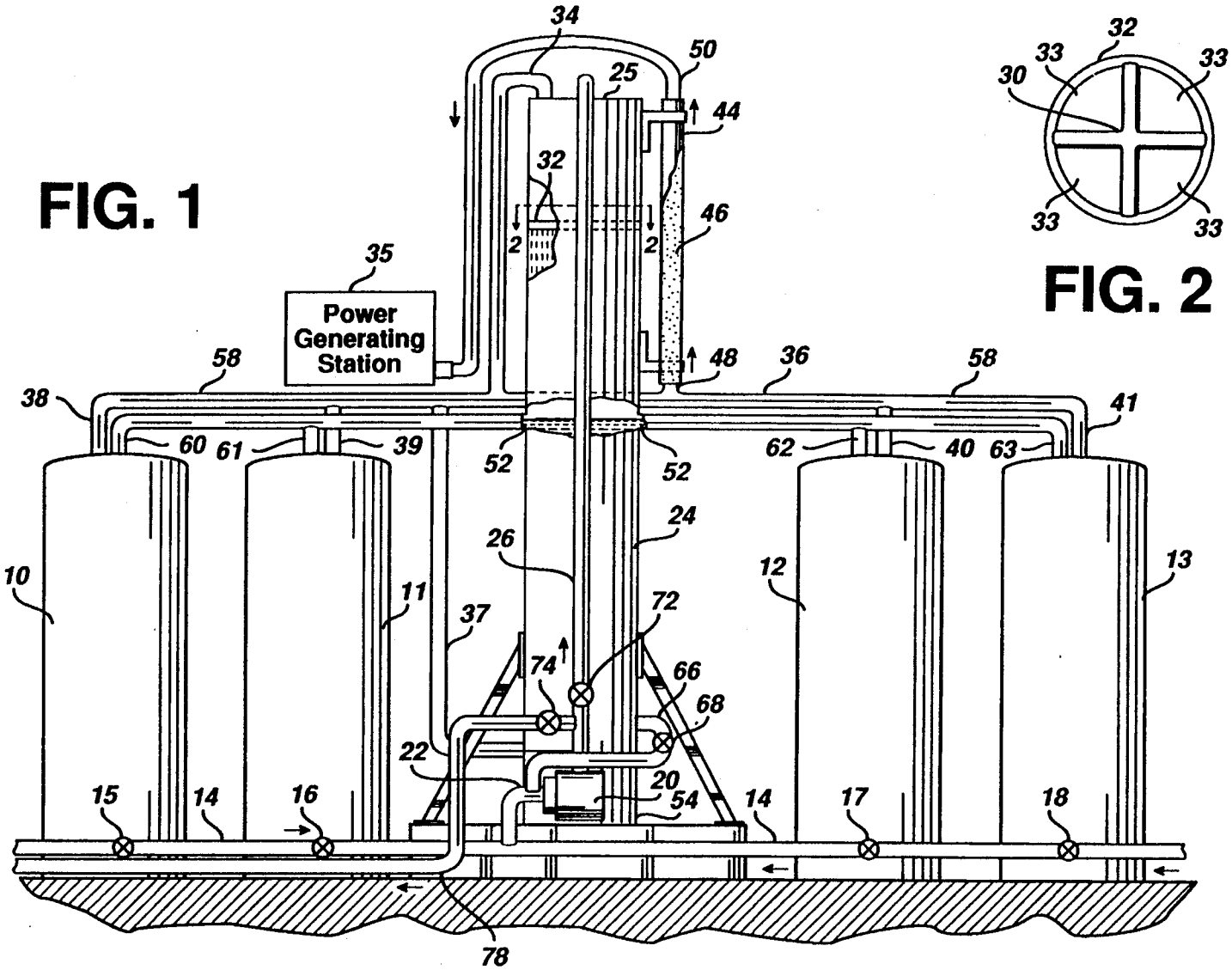
FIG. 1 is schematic view of a process and apparatus according to the invention, partially broken away for clarity.
FIG. 2 is a cross-section taken along line 2—2 in FIG. 1.

Blended gasolines according to the invention are produced by blending a natural gasoline component with at least one octane-enhancing component, preferably toluene. The natural gasoline component preferably comprises primarily hydrocarbons having about 4 to about 12 or more carbons. At least about 60 volume percent, however, of the natural gasoline component should preferably be pentanes and hexanes, and at least about 20 volume percent should preferably have about 7 or more carbons. The natural gasoline components can be extracted from raw natural gas sources consisting mainly of methane. Most of the methane, together with ethane, propane, and some butanes, exit from the process with only the natural gasoline being condensed and collected by suitable methods known in the art, including cascade refrigeration extraction processes. These methane rich streams, free of natural gasoline components, are used principally as a fuel in homes and in power generating stations. Excess low-weight hydrocarbons can be sold separately.

The octane-enhancing component can be selected from several suitable compounds, and can also include mixtures of compounds. The octane-enhancing components will preferably have a high octane rating with an (R+M)/2 octane of greater than about 85. The octane-enhancing components should preferably also have a low vapor pressure, with a Reid vapor pressure of less than about 8 psia, and most preferably of about 1 psia or less.

Toluene, alone or in combination with other octane-enhancing components, is a presently preferred octane-enhancing component. The toluene component should be relatively pure, although up to about 10 volume percent of the toluene component can be other hydrocarbon aromatics having six to nine carbon atoms. Other suitable octane-enhancing components include methyl tertiary butyl ether (MTBE); tertiary anyl methyl ether (TAME); ethyl tertiary butyl ether (ETBE); ethylbenzene; m-xylene; p-xylene; o-xylene; eight carbon aromatic mixtures; nine carbon aromatic mixtures; cumene (isopropylbenzene); n-propylbenzene; alkylates (isoparaffins); catalytic cracked naphtha; catalytic reformate; and pyrolysis gasoline.

The product gasoline should have an (R+M)/2 octane rating of at least 80 and a Reid vapor pressure of no more than about 12–14 psia in winter conditions, and about 8–10 psia in summer conditions. A low-weight hydrocarbon component can be added to the natural gasoline component and the octane-enhancing component in order to more economically produce a merchantable liquid fuel for internal combustion engines having a sufficiently low Reid vapor pressure and a satisfactory octane rating. This will depend on current commodity prices. The low-weight hydrocarbon component can contain hydrocarbons having from about 1 to more than about 7 carbons, and in varying proportions. It is preferred, however, that at least about 50 volume percent of the low-weight hydrocarbon components be butanes and pentanes.

If low-weight hydrocarbons are used, it is preferable to initially blend the natural gasoline component with the low-weight hydrocarbon component. It is anticipated that approximately 1–3 volume percent light-weight hydrocarbons will be weathered off in the process. These will include methane, ethane, propane and some butane. These light-weight hydrocarbons are weathered off during the blending operation, and can be combusted to generate power and to run pumps used in blending. Excess vapor can be stored by suitable means such as underground storage wells or compressed-gas vessels.

The components can be mixed together thoroughly by suitable mixing apparatus, and the mixture is caused to attain a liquid form having an extended surface area, such as droplets or a film-like surface area. This has been found to facilitate the release of light-weight hydrocarbons from the liquid. A vapor stream is withdrawn to remove these light-weight hydrocarbons including methanes, ethanes, propanes and some butanes. The pressure is preferably maintained at about 2–15 psig, which allows the lightweight hydrocarbon vapors to be released from the process and passed to storage or a power generating station. The octane-enhancing components, preferably toluene, are added to the low-weight hydrocarbon/natural gasoline mixture, or to just the natural gasoline component when the low-weight component is excluded, such that the octane-enhancing components are approximately 15–55 volume percent of the mixture.

The liquid mix is preferably agitated, or otherwise caused to take a liquid form having an extended surface area, in an enclosure having a vapor space. Agitation will blend the components and will cause the formation of droplets or a film-like surface area on the side of a vertical vessel, such that the liquid will have an increased surface area relative to the bulk liquid. The extended surface area facilitates the release of light-weight hydrocarbon vapors from the liquid. An enclosure formed as a tower or tank will also provide for a stripping action, which action can also be useful to facilitate the removal of light-weight hydrocarbons and to minimize the escape of higher-weight hydrocarbons. Vapor flows upward to a vapor space and liquid flows downward to a liquid space of the enclosure. The vapor stream is withdrawn from the vapor space. The contact of the rising vapors with the falling liquid will help to retain heavier hydrocarbons in the falling liquid.

The high surface area form of the liquid can be created by directing the liquid mixture into a dispersing, spraying or splashing device positioned in the enclosure. Other known methods for increasing the surface area of liquids, such as passing the liquid through a packed column or over plates in a column, are also possible. These structures will also act to blend the liquid components together. It might also be possible to facilitate the removal of light-weight hydrocarbons by the introduction of a stripping gas, or by the application of heat. It is a feature of the invention, however, that the natural gasoline can be successfully processed in a substantially isothermal process, without the introduction of heat.

The mixing process preferably continues as a batch process until a substantially homogeneous mixture results with the desired Reid vapor pressure. Intermediate storage tanks can be provided to collect the mixture. Recirculation pumps can be utilized to return the liquid from the intermediate storage tanks to the agitation/-mixing step.

Condensing or coalescing apparatus can be provided to condense or coalesce low-weight hydrocarbons from the vapor stream, and these low-weight hydrocarbons can be returned to the mixing process. The condensing or coalescing apparatus can be of any suitable design, but preferably has a large amount of condensing or coalescing surface area such as would be provided by conventional tower packing material. A ceramic packing is presently preferred, although other materials, including stainless or carbon steel, could also be useful.

The removal of light-weight hydrocarbons from the natural gasoline component can occur before and/or after the introduction of the octane-enhancing components. It is presently preferred that at least some removal of light-weight hydrocarbons according to the invention occur after the introduction of the octane-enhancing components. It is possible to mix the natural gasoline component with the octane-enhancing component in a separate operation, however, a thorough mixing will usually result from the agitation or other process used to remove the light-weight hydrocarbons from the natural gasoline.

A presently preferred mixing apparatus according to the invention is shown in FIGS. 1–2. A number of storage tanks 10–13 can be provided, although more or fewer storage tanks can be provided if desired. The liquid components to be mixed can initially be stored in the tanks 10–13. Liquid exits the tanks 10–13 through a liquid return path 14 and by operation of valves 15–18. Liquid from the return path 14 enters one or more high output liquid pumps 20 through a pump suction or inlet path 22. The pump 20 moves the liquid to an agitating or high-surface area generating apparatus, such as the mixing column or tank 24. A riser conduit 26 conducts the liquid to the top 25 of the column 24. The liquid exits the riser conduit 26 in the downward direction, and can be directed at a center surface 30 of a mechanical device such as the splash tray 32. Liquids pass the splash tray 32 through openings 33. The mechanical device can be constructed from many alternative designs, but is intended to agitate the liquid to promote mixing, droplet and/or film formation, thus facilitating the release of light-weight hydrocarbon vapors. Alternative means known in the art for agitating liquids, causing the liquid to take on a high surface area form, and for removing vapors from liquids, could also be utilized, including impellers, pipe mixers, and packing. Known optimization techniques can be utilized to further facilitate the withdrawal of vapors from the liquid blends. The invention permits the removal of light-weight hydrocarbons in a substantially isothermal process, without the introduction of heat, however, heat can also be utilized where deemed necessary.

Light hydrocarbon vapors released by this agitation and increased surface area flow upwards through the vessel or tower counter-current to the downward flowing liquid droplets and film. There is an equilibrium exchange between this counter-current liquid and vapor flow such that heavier components are knocked downwards from the vapor and lighter components are liberated from the liquid. Vapors flow to, and are withdrawn from, a vapor space at the top of the mixing column 24. The vapors exit the column 24 through a vapor outlet path 34. Some vapors will condense in the vapor outlet path 34, and are returned to the tanks 10–13 through a vapor manifold 36 and vapor return paths 38–41. Vapors exiting the vapor manifold 36 are preferably processed in one or more coalescing or condensation steps to return to the process any heavier hydrocarbons which may be present in the vapor stream. A coalescing or condenser apparatus 44 can be filled with a packing 46, which can be selected from several suitable materials and designs, including ceramic spools, which will provide the requisite surface area for coalescing or condensation of the low-weight hydrocarbons. Vapors can enter the coalescing or condenser apparatus 44 through an inlet 48 and exit through a coalescing or condenser outlet 50. Liquid hydrocarbons coalesced or condensed in the coalescing or condenser apparatus 44 can fall under the influence of gravity into the vapor manifold 36 and return to the storage tanks 10–13 through the vapor return paths 38–41. Alternative coalescing or condensing operations are also possible to coalesce or condense low-weight hydrocarbons from the light-weight hydrocarbon vapors.

The vapors leaving the coalescing or condenser apparatus 44 through the coalescing or condenser outlet 50 will consist primarily of light-weight hydrocarbons such as methanes, ethanes, propanes and some butanes. These hydrocarbons can be combusted in a suitable power generating station 35 to provide energy through a path 37 to run the circulation pumps 20, and to provide for the other energy requirements of the process. Excess vapor can be stored by suitable means such as underground storage wells or compressed-gas vessels.

Liquids passing through the openings 33 in the splash tray 32 can collect in a bottom portion 54 of mixing column or tank 24. Liquid outlets 52 are preferably provided in the sides of the mixing column 24, and are preferably located upwardly from the bottom 54 of the column 24. Liquid hydrocarbons will accumulate in the column to the level of the outlets 52, and will flow out of the column through the outlets 52 into one or more liquid outlet manifolds 58. Liquid in the liquid outlet manifolds 58 is returned to the storage tanks 10–13 through liquid return paths 60–63. The liquid outlets 52 may be positioned in a number of locations in the column or tank 24 below the splash tray 32. The liquid outlets 52 are preferably positioned in the column 24 at a height greater than that of the storage tanks 10–13 to permit gravity flow of the mix from the liquid outlets 52 to the liquid return paths 60-63. Mixture accumulated in the bottom 54 of the tank 24, below the liquid outlets 52, can be recirculated to the pump 20 through a recirculation path 66, which can be controlled by operation of a valve 68.

The product gasoline is pumped from the tanks 10–13 and the column 24 when the weathering process is complete. A valve 72 in the riser path 26 can be closed, and an exit path control valve 74 is opened. The pump 20 then operates to move the gasoline through an exit path 78 to product storage tanks.

The apparatus according to the invention can be constructed from other suitable process components. The number and layout of the tanks 10–13 can be varied Alternative pumping arrangements are also possible. It is possible to replace the column or tank 24 with another mixing apparatus, for example, a pipe mixer apparatus, and to provide alternative means for withdrawing a vapor stream from the mixed product. The design must allow mixing to a substantially homogeneous mixture and the release of enough of the high vapor pressure, light-weight hydrocarbon components to obtain a product with the desired Reid vapor pressure. It is also possible to run the process as a continuous process, as contrasted with the batch process described herein. It is also possible to utilize alternative designs to the splash tray 32. The coalescing or condenser apparatus 44 can be replaced with other suitable coalescing or condenser means, including an artificially cooled condenser, to remove heavier hydrocarbons from the vapor stream.

The proportions of natural gasoline, octane-enhancing components, and any low-weight hydrocarbon components can be adjusted to vary the resulting octane rating and Reid vapor pressure of gasoline products. A low octane gasoline product according to the invention, of about 87 octane, and with a Reid vapor pressure of about 12 psig and an initial boiling point of about 80 degrees F., as might be useful in a winter gasoline, would preferably have the following approximate composition:

Two Component Gasoline

55–85 volume percent natural gasoline
15–45 volume percent octane enhancing components Three Component Gasoline 0–30 volume percent low-weight hydrocarbons
40–85 volume percent natural gasoline
15–45 volume percent octane-enhancing components (preferably toluene)

A summer gasoline mix having an octane rating of about 87 and a Reid vapor pressure of about 9 psig, together with an initial boiling point of more than about 85 degrees F., would preferably have the following composition:

Two Component Gasoline

50–85 volume percent natural gasoline
15–50 volume percent octane-enhancing components Three Component Gasoline 0–15 volume percent low-weight hydrocarbons
45–85 volume percent natural gasoline
15–45 volume percent octane-enhancing components (preferably toluene)

A winter mix gasoline having a high octane rating of approximately 92, together with a Reid vapor pressure of about 12 psig and an initial boiling point of about 80 degrees F would preferably have the following approximate composition:

Two Component Gasoline

45–85 volume percent natural gasoline
15–45 volume percent octane-enhancing components Three Component Gasoline 0–20 volume percent low-weight hydrocarbons
45–85 volume percent natural gasoline
15–45 volume percent octane-enhancing components (preferably toluene)

A summer gasoline mix having a high octane of about 92 and a Reid vapor pressure of about 9 psig, with an initial boiling point of more than about 85 degrees F, would preferably have the following approximate composition:

Two Component Gasoline

45–85 volume percent natural gasoline
15–55 volume percent octane-enhancing components Three Component Gasoline 0–25 volume percent low-weight hydrocarbon
45–85 volume percent natural gasoline
15–55 volume percent octane-enhancing components (preferably toluene)

These proportions are preferred, but it will be understood that additives can be included and the preferred proportions can vary depending upon the precise composition of the various low-weight hydrocarbons, natural gasoline, and octane-enhancing components.

The natural gasoline product of the invention can be blended with other components currently blended with petroleum-derived gasolines. Ethanol in volume percentage up to about 10% or more, if engine design permits, can be utilized to take advantage of governmental incentives, and to improve environmental characteristics through the use of this alternative fuel. This mode of operation also has the advantage of resulting in a normal or low Reid vapor pressure for the finished gasoline. This process is therefore particularly well suited for blending of the sub-octane base fuel with 10% ethanol. The gasolines of the invention can also be blended with methanol according to known methods.

EXAMPLES

The following examples are provided for purposes of illustration, it being understood, however, that the invention is not limited to the precise compositions disclosed therein.

EXAMPLE 1

Feed compositions are provided having the following characteristics:

| Low-weight Hydrocarbons | | |
|---|---|---|
| Component | Liquid Volume % | Weight % (Calculated) |
| Propane | 0.2 | 0.2 |
| Isobutane | 2.2 | 1.9 |
| n-butane | 25.1 | 23.0 |
| Hydrocarbons having | 72.5 | 74.9 |
| 5 or more carbons | 100.0 | 100.0 |
| Reid Vapor Pressure @ 100 degrees F. | | 19 PSIA |
| (R + M)/2 Octane No. | | 76 |
| Specific gravity @ 60 degrees F. | | 0.64 |

| Natural Gasoline | | |
|---|---|---|
| Component | Weight % | |
| n-butane | 4.0 | |
| i-pentane | 15.0 | |
| n-pentane | 23.0 | |
| hexanes | 26.0 | |
| heptanes, and higher- | 32.0 | |
| carbon hydrocarbons | 100.0 | |
| Reid Vapor Pressure @ 100 degrees F. | | 9.5 PSIA |
| (R + M)/2 Octane No. | | 76 |
| Specific gravity @ 60 degrees F. | | 0.68 |

| Toluene | | |
|---|---|---|
| Component | Volume % | |
| Toluene | 99.9 | |
| Reid Vapor Pressure @ 100 degrees F. | | 1.0 PSIA |
| (R + M)/s Octane No. | | 109.5 |
| Specific gravity @ 60 degrees F. | | 0.87 |

The above-described liquid components are blended by first blending the low-weight hydrocarbon component with the natural gasoline component in the proportions given in the preceding formulations for various types of gasolines. This is true for the blends containing the low-weight hydrocarbon component. It is anticipated that 1–3 volume percent light hydrocarbons will be weathered off in the process. These will include methane, ethane, propane and some butanes. The toluene or other octane-enhancing component is then added to the above natural gasoline component or to the above mixture in the proportions given in the preceding formulations for various types of gasolines. In the example embodiment, the tanks 10–13 each have a 20,000 gallon capacity. The column 24 is approximately 60 feet high, about 64 feet over grade, and approximately 26 inches in diameter. The riser 26, liquid manifolds 58, and conduit 14 are each 4 inch standard steel pipe. The vapor line 36 is 2 inch standard steel pipe. The pump 20 is a high output, 900 gallon per minute pump. The size of all equipment can be varied up or down to suit particular capacity requirements.

The pump 20 is operated to circulate the liquid components from the tanks 10–13 to the top of the column 24. The liquid components are directed onto the center 30 of the splash tray 32 to agitate the liquid into droplets and to permit vapors to separate from the liquid components. Liquid vapors exit the column 24 through the vapor outlet path 34, and low-weight hydrocarbons are recovered from the vapor in a coalescing or condenser unit 44. Coalesced or condensed vapors and liquid from the column 24 are returned to the tanks 10–13, and again are circulated by the pump 20. The column 24 is operated at a pressure of about 1–15 psig.

The mixing operation continues as a batch or continuous process until the desired Reid vapor pressure is obtained for the mixture, and the mixture is substantially homogeneous, at which point the composition is approximately 15 volume percent low-weight hydrocarbons, 55 volume percent natural gasoline, and about 30 volume percent toluene. The gasoline produced by the above-described process will have a vapor pressure between about 9–12 psig, and an octane rating of between about 87–92.

EXAMPLES 2–4

A natural gasoline component and toluene component are blended together in approximately the following volume percentages to attain the described octane rating:

| | Finished Gasoline Octane (R + M)/2 | Natural Gasoline | Toluene |
|---|---|---|---|
| Example 2 | 87 | 75 | 25 |
| Example 3 | 90 | 65 | 35 |
| Example 4 | 93 | 55 | 45 |

These components are blended in the tower in the manner described in Example 1 to attain a product having a slightly lowered volume percentage of natural gasoline, from 1–3%, due to light hydrocarbon losses. The percentage of toluene will rise proportionally.

This invention can be embodied in other specific forms without departing from the spirit or essential attributes thereof, and accordingly, reference should be had to the following claims, rather than to the foregoing specification, as indicating the scope of the invention.

I claim:

1. A process for producing liquid fuels for internal combustion engines, comprising the steps of withdrawing a stream of light-weight hydrocarbons from a natural gasoline component, and blending said natural gasoline component with at least one octane-enhancing component, said octane-enhancing component having an (R+M)/2 octane of at least about 85 and a vapor pressure less than about 8 psia.

2. The process of claim 1, comprising the steps of:

a) producing a high-surface area liquid form of at least said natural gasoline component in an enclosure, whereby the release of light-weight hydrocarbons from the bulk liquid components into the enclosure will be encouraged;

b) withdrawing a vapor stream of said light-weight hydrocarbons from said enclosure; and, c) blending said natural gasoline component with said octane-enhancing component, whereby the vapor pressure of the resulting blended liquid product is lower than that of the original combined components.

3. The process of claim 2, wherein said high-surface area producing step a) comprises the creation of droplets from said natural gasoline.

4. The process of claim 3, wherein said droplets are produced by the agitation of said liquid components.

5. The process of claim 4, wherein said agitation step comprises the step of directing a stream of said liquid components against a solid object in said enclosure, said enclosure having a vapor space, said vapor stream being withdrawn from said vapor space.

6. The process of claim 5, wherein said agitation step comprises the step of pumping said liquid components to the top of a column, and directing a stream of said liquid components downwardly against a mechanical device within said column, said liquid components collecting in a bottom, liquid space portion of said column, said vapors flowing to an upper, vapor space portion of said column, said vapor stream being withdrawn from said vapor space portion of said column.

7. The process of claim 2, wherein said vapor stream of step b) is subjected to a liquid removal step comprising at least one of a coalescing or a condensation step, liquid product from said liquid removal step being returned to said high-surface area producing step a).

8. The process of claim 7, wherein said coalescing step comprises passing said vapor stream through an enclosure having high surface area coalescing means.

9. The process of claim 8, wherein said liquid removal step comprises passing said vapor stream through a column containing packing.

10. The process of claim 2, wherein bulk liquid product is collected from said high-surface area producing step a) and is returned to said step a) through a continuous recycling process.

11. The process of claim 1, wherein said octane-enhancing components are selected from the group consisting of toluene; methyl tertiary butyl ether; tertiary anyl methyl ether; ethyl tertiary butyl ether; ethylbenzene; m-xylene; p-xylene; o-xylene; eight carbon aromatic mixtures; nine carbon aromatic mixtures; isopropylbenzene; n-propylbenzene; alkylates, catalytic cracked naphtha; catalytic reformate; and pyrolysis gasoline.

12. A process for producing liquid fuel for internal combustion engines, comprising the steps of:

a) blending liquid components comprising a natural gasoline component and at least one octane-enhancing component;

b) producing a high-surface area form of said liquid components of step a) in an enclosure having a vapor space portion and a liquid space portion, said liquid components collecting in said liquid space portion of said enclosure, vapors accumulating in said vapor space portion of said enclosure, a vapor stream being withdrawn from said vapor space portion of said enclosure;

c) a liquid removal step in which low-weight hydrocarbons present in said vapor stream are removed and returned to said blending step a), said liquid removal step further producing a light-weight hydrocarbon vapor product;

d) said light-weight hydrocarbon vapor product of said liquid removal step c) being burned to generate power, said power being utilized to provide energy for said process; and, e) said process continuing until said liquid components have a composition of between about between about 60 and about 80 volume percent natural gasoline, and between about 20 and about 40 volume percent octane-enhancing components.

13. A process for producing a liquid fuel for internal combustion engines, comprising the steps of:

a) blending liquid components comprising a natural gasoline component and an octane-enhancing component; and, b) withdrawing a vapor stream of light-weight hydrocarbons from said liquid components, whereby the vapor pressure of the resulting blended liquid product will be decreased.

* * * * *